US008514136B2

(12) United States Patent
McCarthy et al.

(10) Patent No.: US 8,514,136 B2
(45) Date of Patent: Aug. 20, 2013

(54) CONFORMAL HIGH FREQUENCY ANTENNA

(75) Inventors: Dennis K. McCarthy, Gilbert, AZ (US); Neal E. Tornberg, Mesa, AZ (US); Ronald O. Lavin, Gilbert, AZ (US); Michael J. Valle, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 596 days.

(21) Appl. No.: 12/605,948

(22) Filed: Oct. 26, 2009

(65) Prior Publication Data

US 2011/0095951 A1 Apr. 28, 2011

(51) Int. Cl.
*H01Q 1/28* (2006.01)

(52) U.S. Cl.
USPC ..... 343/705; 343/700 MS; 343/767

(58) Field of Classification Search
USPC ..... 343/700, 705, 767, 770
See application file for complete search history.

(56) References Cited

U.S. PATENT DOCUMENTS

| | | | | |
|---|---|---|---|---|
| 2,990,547 | A * | 6/1961 | McDougal | 343/767 |
| 3,810,183 | A | 5/1974 | Krutsinger et al. | |
| 3,823,404 | A | 7/1974 | Buie, Jr. | |
| 4,816,836 | A | 3/1989 | Lalezari | |
| 4,843,403 | A * | 6/1989 | Lalezari et al. | 343/767 |
| 5,333,002 | A | 7/1994 | Gans et al. | |
| 5,437,091 | A | 8/1995 | Norman | |
| 5,646,633 | A | 7/1997 | Dahlberg | |
| 5,872,546 | A * | 2/1999 | Ihara et al. | 343/795 |
| 6,198,445 | B1 | 3/2001 | Alt et al. | |
| 6,914,563 | B2 | 7/2005 | Chen et al. | |
| 7,233,295 | B2 | 6/2007 | Regala | |
| 2004/0070536 | A1 | 4/2004 | Stotler et al. | |
| 2006/0250317 | A1 | 11/2006 | Regala | |
| 2007/0194999 | A1 | 8/2007 | Morton | |
| 2008/0316124 | A1 | 12/2008 | Hook | |

FOREIGN PATENT DOCUMENTS

| | | | |
|---|---|---|---|
| EP | 2065976 | A1 | 6/2009 |
| JP | 63181505 | A | 7/1988 |
| WO | WO 99/36988 | A1 | 7/1999 |

OTHER PUBLICATIONS

Combined Search and Examination Report, Great Britain Application No. GB1017823.4, Intellectual Property Office, Great Britain, Feb. 18, 2011, (7 pgs).

Examination Report under Section 18(3), Great Britain Application No. GB1017823.4, Intellectual Property Office, UK Feb. 16, 2012, (2 pgs).

* cited by examiner

*Primary Examiner* — Tho G Phan
(74) *Attorney, Agent, or Firm* — Toler Law Group

(57) ABSTRACT

Antennas, integrated driveshaft covers, and methods are disclosed. A particular antenna includes a dielectric layer. The dielectric layer has a first curved surface and a second curved surface opposite the first curved surface. A conductive body has a curved outer surface, where the first curved surface of the dielectric layer is positioned against the curved outer surface. A high frequency (HF) antenna layer is positioned over positioned over the second curved surface of the dielectric layer, where the HF antenna layer is curved to conform to the second curved surface of the dielectric layer. A pair of contacts may be configured to receive an electrical connection for the HF antenna layer. When an HF signal is applied to the pair of contacts, the conductive body interacts with the HF antenna layer to radiate energy.

16 Claims, 10 Drawing Sheets

CONFORMAL HIGH FREQUENCY ANTENNA

FIELD OF THE DISCLOSURE

The present disclosure is generally related to a high frequency range antenna including or mounted upon a curved conductive body such as a drive shaft cover of a helicopter.

BACKGROUND

Many competing concerns may be considered in designing and outfitting a vehicle such as an aircraft. For example, it is desirable for the aircraft to be durable and to have good aerodynamics while, at the same time, it is desirable for the aircraft to be inexpensive to build and to include a full complement of desired features.

Providing adequate antennas is one exemplary design issue that can raise such competing concerns. To provide desired bandwidth coverage, an antenna may be subject to particular size and location constraints. At the same time, however, if the antenna protrudes from the aircraft body, the antenna may be exposed to accidental damage from ground personnel or airborne objects, and the antenna may also detract from the aerodynamics of the aircraft.

In the case of helicopters, finding an available area on the outside of a helicopter body to mount an antenna where the antenna will not interfere with a rotor, a stabilizer, or control surfaces of the helicopter can be difficult. There may be little available area on the helicopter body to mount such an antenna where the antenna can provide coverage in all directions around the helicopter. Mounting a "towel bar" type antenna on a tail boom section of a helicopter makes use of available, largely unused space on the helicopter. However, towel bar type antennas extend outward from the tail boom section and may be subject to damage by personnel servicing the helicopter when the helicopter is not in flight.

SUMMARY

Embodiments disclosed herein include conformal antennas, integrated driveshaft covers for helicopters, and methods for providing a conformal drive shaft cover high frequency (HF) antenna. A curved conductive body may provide a base for a conformal antenna. For example, a driveshaft cover, such as may be found on an upper surface of a helicopter tail boom section, may provide a maintenance access point to enable work to be done on the tail rotor drive shaft and its associated linkages. The driveshaft cover also may provide a curved conductive body for use in a conformal antenna.

Taking the example of mounting a conformal antenna on a driveshaft cover of a helicopter, the conformal antenna may be mounted on or integrated with the driveshaft cover. In either embodiment, the driveshaft cover and antenna become a unified radiating system. The drive shaft cover, which may be constructed of a conductive material, provides a base for the HF antenna. The HF antenna may include a dielectric layer positioned over substantially all of an outward-facing area of the driveshaft cover. A conductive antenna layer may be positioned over the dielectric layer. The conductive antenna layer, in one embodiment, is a slotted antenna with an interior slot that runs substantially along a length of the driveshaft cover. The conductive antenna layer may be coupled to a radio transceiver by a pair of leads joined to contacts on opposing sides of the interior slot at a mid-point of the length of the interior slot. Size and shape of the antenna layer may be selected to provide effective transmission and reception in HF frequency bands between approximately 1.8 megahertz and 30 megahertz.

In a particular illustrative embodiment, an antenna includes a dielectric layer that has a first curved surface and a second curved surface opposite the first curved surface. A conductive body has a curved outer surface, where the first curved surface of the dielectric layer is positioned against the curved outer surface. A high frequency (HF) antenna layer is positioned over the second curved surface of the dielectric layer, where the HF antenna layer is curved to conform to the second curved surface of the dielectric layer. A pair of contacts may be configured to receive an electrical connection for the HF antenna layer. When an HF signal is applied to the pair of contacts, the conductive body interacts with the HF antenna layer to radiate energy.

In another particular illustrative embodiment, an integrated driveshaft cover antenna includes a driveshaft cover including a metal layer. The driveshaft cover is configured to be hingeably secured and electrically coupled to an aircraft tail boom section to cover a driveshaft access opening. A dielectric layer includes a first surface shaped to conform to a curved outer surface of the driveshaft cover and a second surface opposite the first surface. The dielectric layer covers a majority of an area of the curved outer surface of the driveshaft cover. The first surface is secured to the curved outer surface of the driveshaft cover. A slotted patch HF antenna layer is secured to the second surface of the dielectric layer. The slotted patch HF antenna layer has an inner slot. The slotted patch HF antenna layer extends a majority of a length of the dielectric layer.

In still another particular illustrative embodiment, a method includes providing a dielectric layer having a first face and a second face opposite the first face and having a generally uniform thickness between the first face and the second face. The first face of the dielectric layer is positioned over at least a portion of a curved outer surface of a conductive body. The first face is curved along a first dimension to match a first curvature of the curved outer surface. A curved conductive antenna layer is positioned over the second face of the dielectric layer, where the curved conductive antenna layer is curved along the first dimension to match a second curvature of the second face. The curved conductive layer has opposing antenna faces. The curved antenna layer includes an interior slot between the first antenna face and the second antenna face. The interior slot has a slot length that extends perpendicularly to the first curvature. Transceiver leads are coupled to opposing edges of the interior slot at a midpoint of the slot length.

The conformal HF antenna or integrated driveshaft cover antenna provides HF coverage in a wide pattern and over a wide frequency range. At the same time, the antenna does not extend outward from the body of the helicopter or other vehicle or structure on which the antenna is mounted. Thus, the antenna is protected from damage. The antenna also does not appreciably affect the aerodynamics of an aircraft or other vehicle on which the antenna is mounted.

The features, functions, and advantages that have been described can be achieved independently in various embodiments or may be combined in yet other embodiments, further details of which are disclosed with reference to the following description and drawings.

DETAILED DESCRIPTION

Particular illustrative embodiments of a conformal driveshaft cover high frequency (HF) antenna make effective use of available aircraft surface space or other surface space while providing a durable, functional HF antenna enabling HF radio communications. For example, by positioning the conformal HF antenna on a driveshaft cover of a helicopter or integrating the conformal HF antenna with the driveshaft cover, an ordinary access panel is replaced with an access panel that functions as part of a radiating HF antenna. The conformal HF antenna may include a dielectric layer and an antenna layer, such as a slotted antenna, that substantially cover the driveshaft cover. The dimensions and configuration of the conformal antenna may enable the aircraft to engage in radio communications in HF frequency bands without the use of a protruding antenna.

Embodiments of the conformal HF antenna of the present disclosure are not limited to any particular implementation. The present disclosure describes the implementation of a conformal driveshaft cover-based HF antenna mounted on a helicopter as an illustrative example of a conformal antenna that provides desirable radio capabilities, is durable, and makes use of available and potentially underutilized space on a vehicle or other object. The example is provided by way of illustration rather than by limitation; conformal antennas according to the present disclosure may be used on any type of vehicle-based or non-vehicle-based installations.

Figure 1:
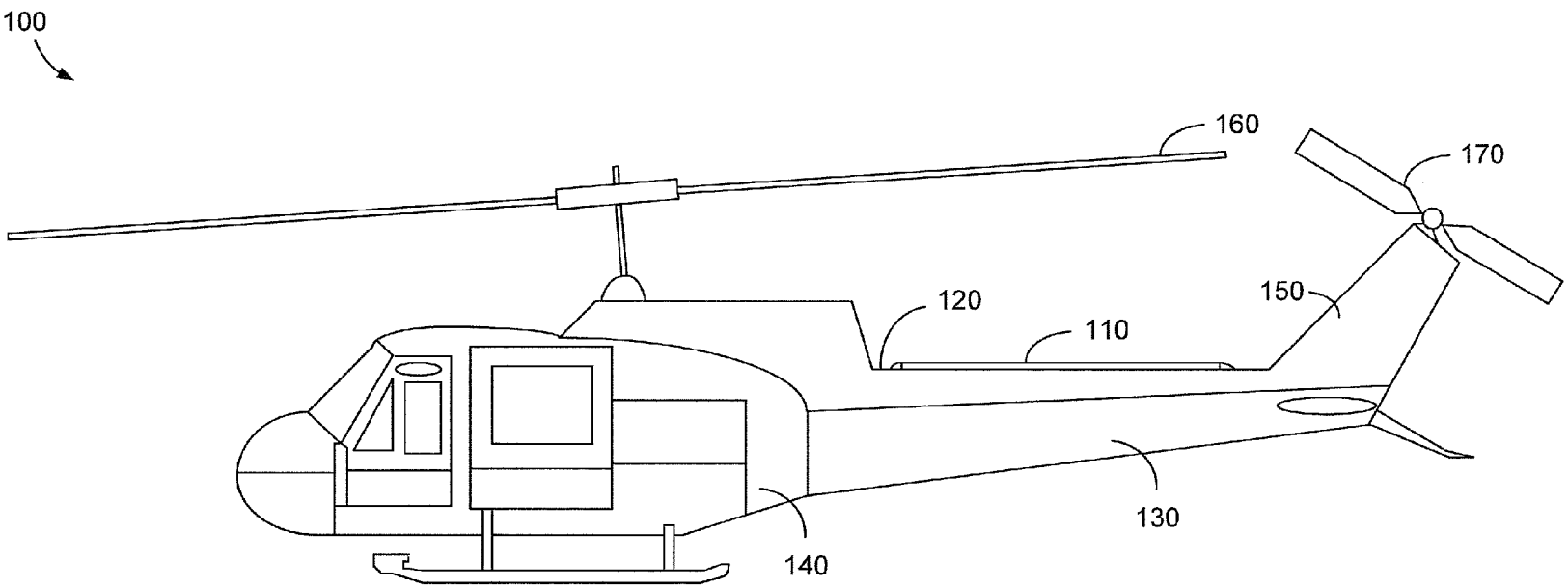
FIG. 1 is a side view of an exemplary helicopter equipped with a conformal driveshaft cover high frequency (HF) antenna on an upper surface of a tail boom section.

FIG. 1 is a side view of an exemplary helicopter 100 equipped with a conformal driveshaft cover high frequency (HF) antenna 110 on an upper surface 120 of a tail boom section 130. The tail boom section 130 extends from a main fuselage 140 of the helicopter 100, and includes a tail boom (not shown) that physically supports a tail section 150. Inside the tail boom section 130, a driveshaft and associated linkages (not shown in FIG. 1) extend from a main engine (also not shown in FIG. 1) that drives a main rotor 160. The driveshaft carries power from the main engine to the tail section 150 to drive a tail rotor 170 of the helicopter 100.

The conformal driveshaft cover HF antenna 110 is positioned on a driveshaft cover (which in FIG. 1 is completely covered and thus visually blocked by the conformal driveshaft cover HF antenna 110). The driveshaft cover is a doorway in the upper surface 120 of the tail boom section 130 that affords access to the driveshaft system and other components housed in the tail boom section 130. The driveshaft cover may be long enough to permit access to ends of the driveshaft and wide enough to enable personnel to work with their hands and various tools inside a cavity adjacent the tail boom within the tail boom section 130.

In a particular embodiment, the driveshaft cover is hingeably attached to the tail boom section 130. In this embodiment, the driveshaft cover is more easily replaced or operated upon than fixed portions of the tail boom section 130. By installing the conformal driveshaft cover HF antenna 110 on the driveshaft cover or integrating the conformal driveshaft cover HF antenna 110 with the driveshaft cover, an existing maintenance access panel may be adapted to serve a useful purpose during flight of the helicopter 100.

Figure 2:
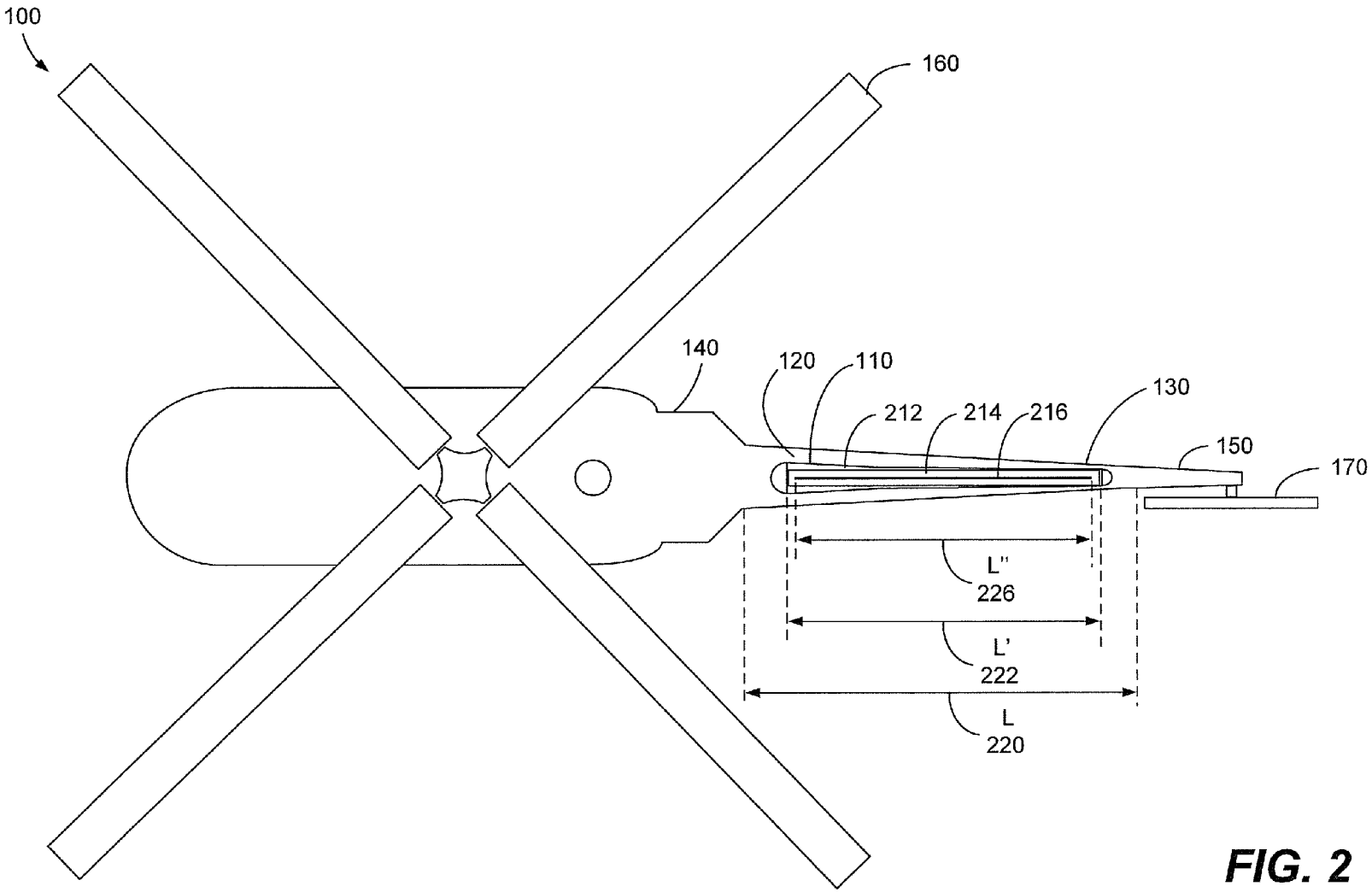
FIG. 2 is a top view of the helicopter of FIG. 1 showing the conformal driveshaft cover HF antenna.

FIG. 2 is a top view of the helicopter 100 of FIG. 1 showing the conformal driveshaft cover HF antenna 110. In a particular embodiment, the conformal driveshaft cover HF antenna 110 has an area that generally covers the driveshaft cover, blocking a view of the driveshaft cover in FIG. 2. As shown in FIG. 2, the conformal driveshaft cover HF antenna 110 has a length L' 222 that, like the driveshaft cover, extends most of a length L 220 of the tail boom section 130.

The conformal driveshaft cover HF antenna 110 may include a dielectric layer 212 positioned over the driveshaft cover. A conductive antenna layer 214 may be positioned over the dielectric layer 214. In one particular illustrative embodiment, the conductive antenna layer 214 extends approximately the full length L' 222 of the dielectric layer 212. In a particular embodiment, the conductive antenna layer 214 is not as wide as the dielectric layer 212. In one particular illustrative embodiment, the conductive antenna layer 214 is a slotted patch antenna. The conductive antenna layer 214 may include an interior opening or slot 216 that has a length L" 226 that extends a majority of the length L' 222 of the dielectric layer 212. Conductors from a transceiver of the helicopter 100 may be coupled to opposing interior edges of the interior slot 216 at a midpoint of the interior slot 216 to support a desired radiating pattern.

Figure 3:
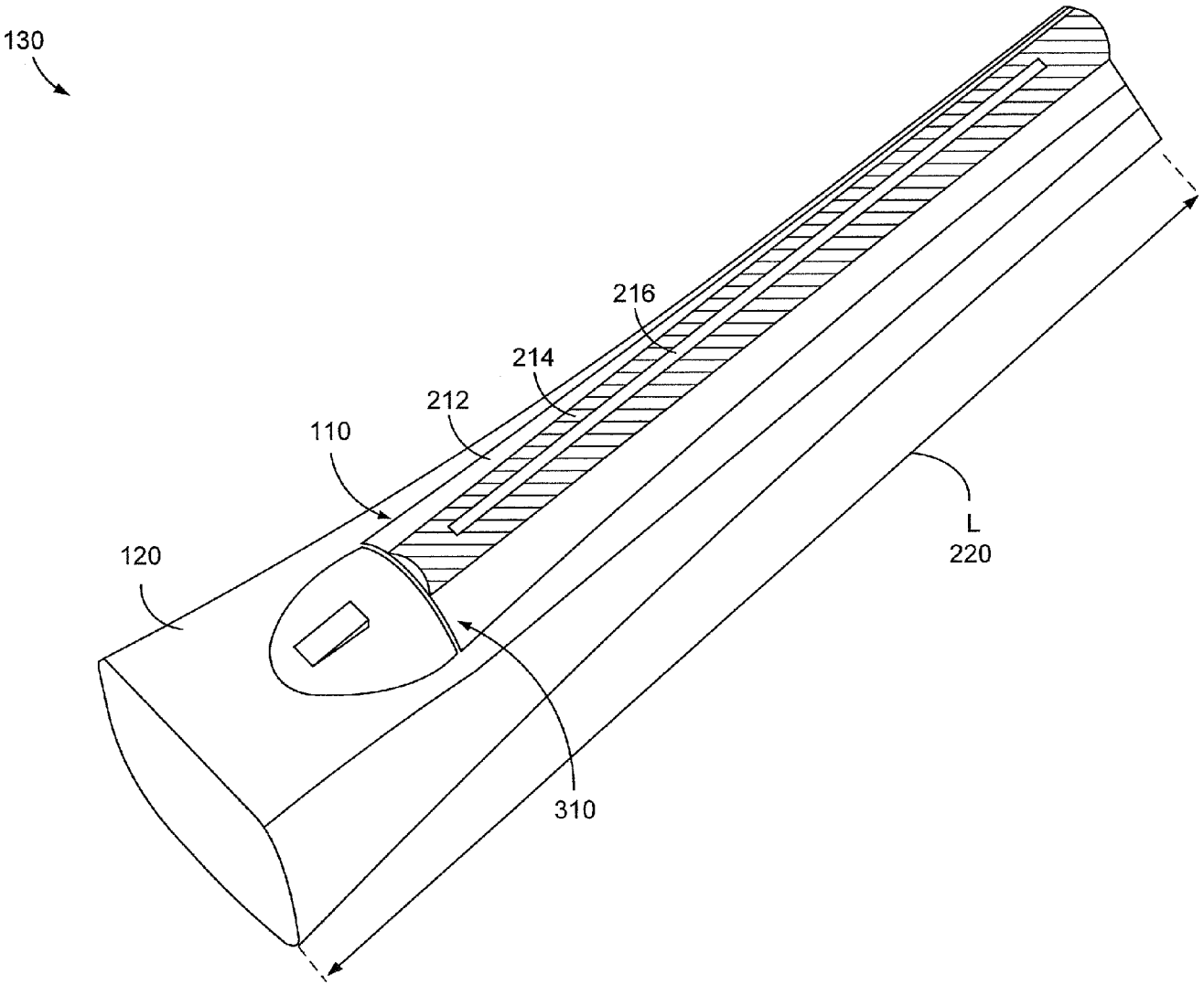
FIG. 3 is a perspective view of the tail boom section of the helicopter of FIG. 1 showing an enlarged view of the conformal driveshaft cover HF antenna.

FIG. 3 is a perspective view of the tail boom section 130 of the helicopter 100 of FIG. 1. FIG. 3 shows an enlarged view of the conformal driveshaft cover HF antenna 110 and a portion of the upper surface 120 of the tail boom section 130. The conformal driveshaft cover HF antenna 110 has a curvature 310 transverse to the length L 220 of the tail boom section 130. The curvature 310 may be comparable to that of an ordinary tail boom section driveshaft cover (i.e., a driveshaft cover that does not include an HF antenna). The curvature 310 may provide increased interior space adjacent the tail boom section 130 to accommodate the driveshaft or other internal components (not shown) of the tail boom section 130. In a particular illustrative embodiment, the dielectric layer 212 and the conductive antenna layer 214 are curved across the conformal driveshaft cover HF antenna 110 transverse to the length L 220 of the tail boom section 130. The interior slot 216 may be positioned at a mid-point of the curvature 310. For example, the interior slot 216 may be located at a top of the conformal driveshaft cover HF antenna 110.

Figure 4:
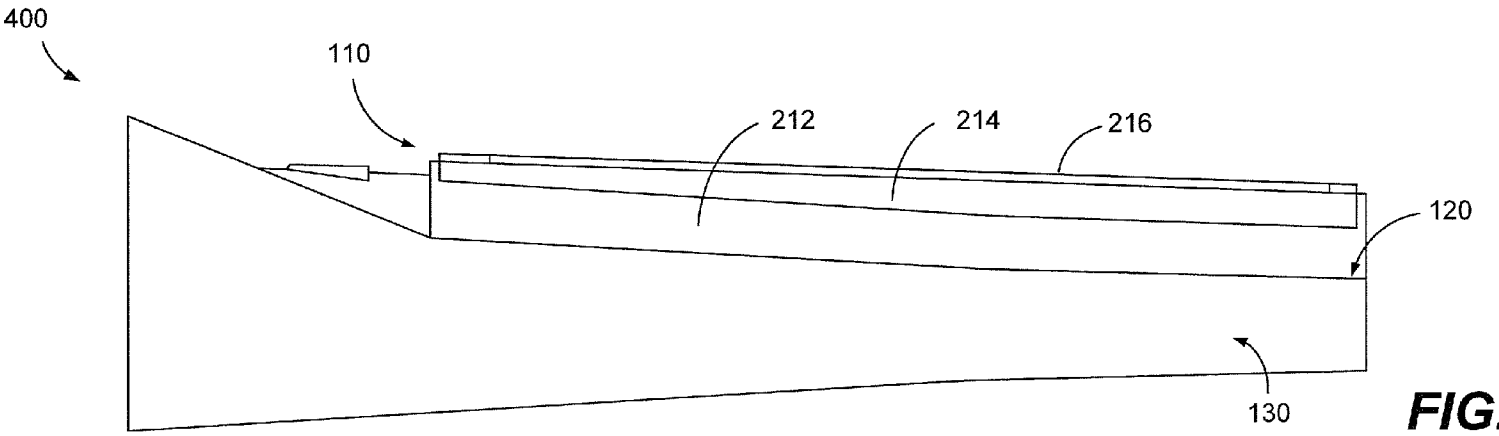
FIGS. 4 and 5 are side views of the tail boom section of FIG. 3 showing a hingeably-mounted conformal driveshaft cover HF antenna in closed and open positions, respectively.
Figure 5:
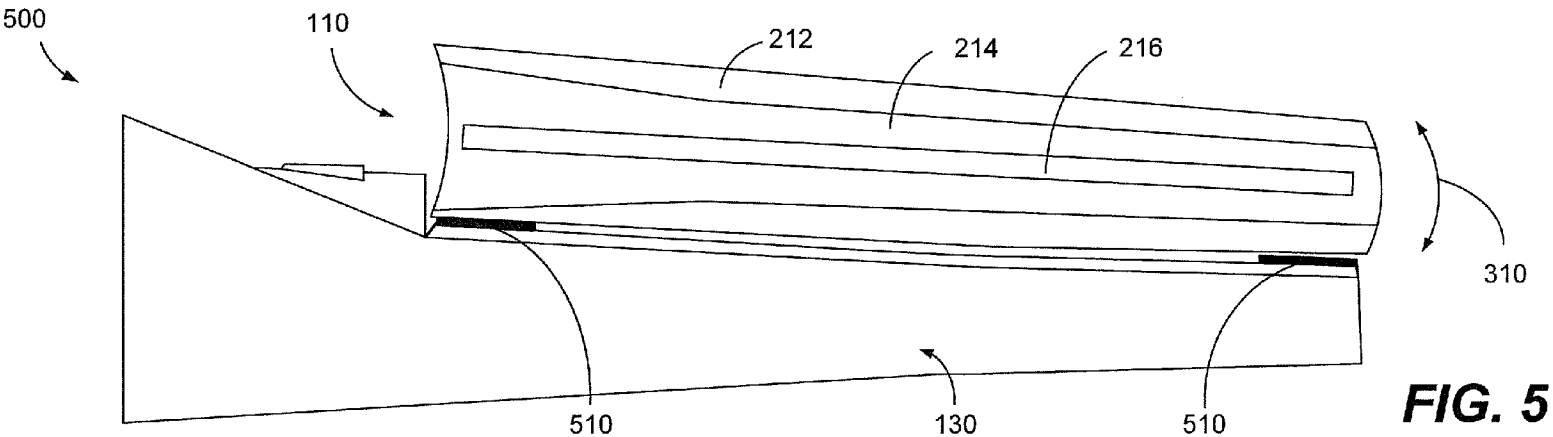

FIGS. 4 and 5 are side views 400 and 500 of the tail boom section 130 of FIG. 3 showing a hingeably-mounted conformal driveshaft cover HF antenna 110 in closed and open positions, respectively. The side view 400 of FIG. 4 shows the dielectric layer 212 extending from the upper surface 120 of the tail boom section 130 toward the interior slot 216 that is positioned at a top of the conformal driveshaft cover HF antenna 110.

The side view 500 of FIG. 5 illustrates the curvature 310 of the conformal driveshaft cover HF antenna 110 in an open position. FIG. 5 also shows a pair of hinges 510 that hingeably attach the conformal driveshaft cover HF antenna 110 to the tail boom section 130. In a particular embodiment, the hinges 510 are similar to, interchangeable with, interoperable with, or identical to hinges used to hingeably attach a conventional driveshaft cover to the tail boom section 130 to enable the conventional driveshaft cover to be easily replaced by the conformal driveshaft cover HF antenna 110.

Figure 6:
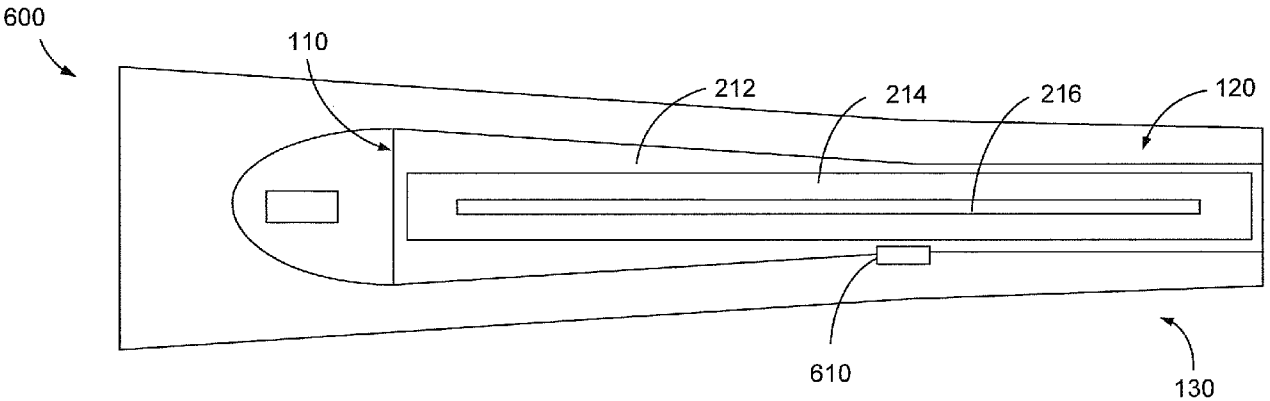
FIGS. 6 and 7 are top views of the tail boom section of FIGS. 4 and 5 showing the hingeably-mounted conformal driveshaft cover HF antenna in closed and open positions, respectively.
Figure 7:
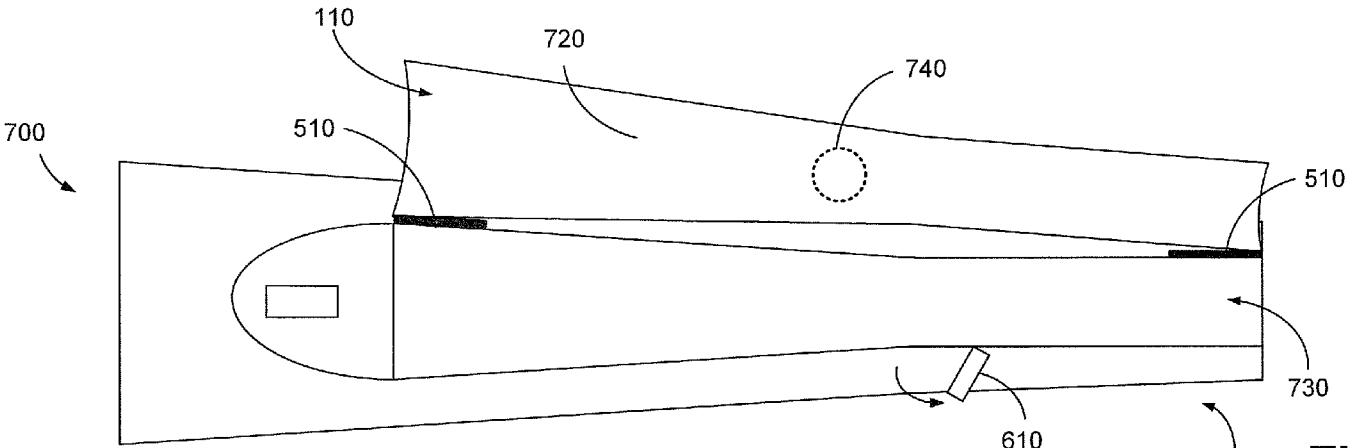

FIGS. 6 and 7 are top views 600 and 700 of the tail boom section 130 of FIGS. 4 and 5 showing the hingeably-mounted conformal driveshaft cover HF antenna 110 in closed and open positions, respectively. As shown in the closed view 600 of FIG. 6, when the conformal driveshaft cover HF antenna 110 is in the closed position, the conformal driveshaft cover HF antenna 110 may be secured to the tail boom section 130 by one or more latches 610. The latch 610 may be a pawl latch, a buckle, or any other suitable type of mechanical latch to hold the conformal driveshaft cover HF antenna 110 in a closed position when desired. In a particular embodiment, the latch 610 is similar to, interchangeable with, or the same as one or more latches used to secure a conventional driveshaft cover in a closed position to enable the conventional driveshaft cover to be easily replaced by the conformal driveshaft cover HF antenna 110.

The top view 700 of FIG. 7 shows the conformal driveshaft cover antenna 110 in the open position. FIG. 7 shows the latch 610 in an open position. When the latch 610 is in the open position, the conformal driveshaft cover HF antenna 110 may be raised on the hinges 510 to permit access to an underside 720 of the conformal driveshaft cover HF antenna 110 as well as to an interior 730 of the tail boom section 130. In a particular illustrative embodiment, the underside 720 of the conformal driveshaft cover HF antenna 110 is a bottom layer of the conformal driveshaft cover HF antenna 110. In a particular embodiment, the underside 720 of the conformal driveshaft cover HF antenna 110 is a conductive panel, comprised of metal or another material, made of the same material as a remainder of the tail boom section 130. In this embodiment, the conductive panel may be electrically and mechanically secured to the tail boom section 130 by the hinges 510, the latch 610, one or more other connectors, or any combination thereof. The conductive layer may provide a radiating base for other layers 212 and 214 of the conformal driveshaft cover HF antenna 110. For example, the conductive layer may interact with the HF antenna layer to radiate the energy.

As also shown in FIG. 7, the underside 720 of the conformal driveshaft cover HF antenna 110 may include an access opening 740 to enable electrical connections to be made to the antenna layer 214 (not shown in FIG. 7) by conductors (also not shown in FIG. 7) extending through portions of the conformal driveshaft cover HF antenna 110. In a particular embodiment, the electrical connections to the antenna layer 214 are made at opposing sides at a mid-point of the interior slot 216. Thus, the access opening 740 may be positioned generally at a mid-point of the conformal driveshaft cover HF antenna 110 to lie beneath the mid-point of the interior slot 216 (not shown in FIG. 7). However, in other configurations, the electrical connections to the antenna layer may be made at other locations of the antenna layer 214. Additionally, in other configurations, the electrical connections may be made using wire or other conductors that extend between the dielectric layer 212 of the conformal driveshaft cover HF antenna 110 and the driveshaft cover.

Figure 8:
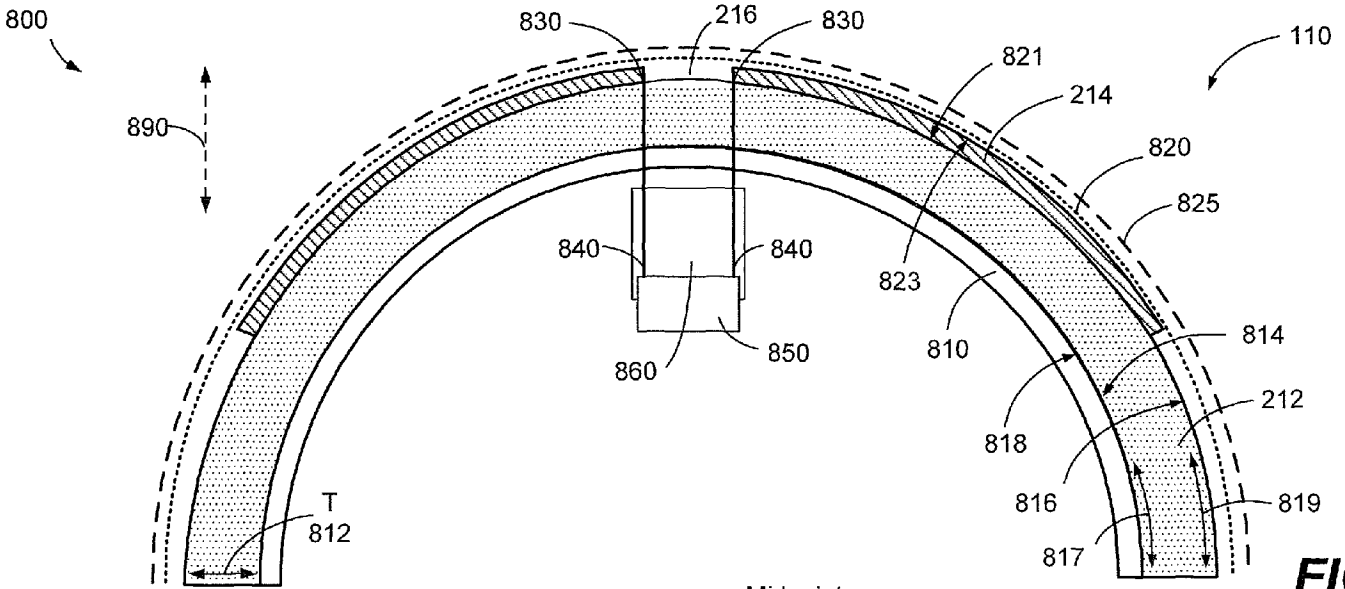
FIG. 8 is a cross-sectional view of the conformal driveshaft cover HF antenna at a mid-point of the conformal driveshaft cover HF antenna.

FIG. 8 is a cross-sectional view 800 of the conformal driveshaft cover HF antenna 110. The cross-sectional view 800 is taken approximately at a mid-point along a length of the conformal driveshaft cover HF antenna 110. The cross-sectional view 800 illustrates electrical connections to the conformal driveshaft cover HF antenna 110. For example, the cross-sectional view 800 shows a first face 814 of the dielectric layer 212 positioned over a curved outer surface 818 of a conductive body or conductive layer 810. The conductive body or conductive layer 810 provides a conductive and structurally-supportive base for the conformal driveshaft cover HF antenna 110. The first face 814 of the dielectric layer is curved in a first dimension perpendicular to the thickness T 812 to correspond with a first curvature 817 of the outer surface 818 of the conductive body or conductive layer 810.

According to a particular embodiment, the dielectric layer 212 may be a thermoplastic foam, such as a thermoplastic syntactic, foam, or a polymer foam with a generally uniform thickness T 812 of approximately one half to two inches to desirably insulate the antenna layer 214 from the conductive body or conductive layer 810 to support desired transmission capabilities of the HF antenna 110.

The antenna layer 214 is positioned over a second face 816 of the dielectric layer 212. The antenna layer 214 has a first antenna face 821 and an opposing second antenna face 823. The first antenna face 821 has a curvature in the first dimension that matches a second curvature 819 of the second face 816 of the dielectric layer 812. The interior slot 216 extends between the first antenna face 821 and the second antenna face 823. The interior slot 216 along a slot length that is perpendicular to the first curvature 817 of the outer surface of the conductive body and the second curvature 819 of the second face 816 of the dielectric layer 212.

A protective layer 820 may cover the antenna layer 214, the dielectric layer 212, or both. According to a particular illustrative embodiment, to prevent interference with operation of the conformal driveshaft cover HF antenna 110, the protective outer layer 820 includes a low dielectric loss quartz fiber composite material. ASTROQUARTZ™ is one example of a suitable low dielectric loss material that may provide adequate protection for the conformal driveshaft cover HF antenna 110. In addition, the conformal driveshaft cover HF antenna 110 may include a lightning strike appliqué 825 covering exposed outer surfaces of the slotted patch HF antenna, the dielectric layer, and the driveshaft cover. The lightning strike appliqué 825 may include a an expanded mesh, a nonconductive substrate supporting a plurality of patches of conductive material, or any other form of appliqué configured to disperse electrical charges. The lightning strike appliqué 825 should be of a type that will not interfere or only minimally interfere with HF radio signals. The lightning strike appliqué 825 protects the conformal driveshaft cover HF antenna 110 from damage caused by lightning strikes by dispersing the electric charge throughout the lightning strike appliqué 825 or over the surface of the lightning strike appliqué 825. The lightning strike appliqué 825 may also protect other parts of the helicopter by dispersing the electrical charge presented by a lightning strike before that charge is conducted to the other parts of the helicopter. Note that thicknesses of the protective layer 820 and the lightning strike appliqué 825 may be exaggerated for visual clarity in FIG. 8 from actual thicknesses of the protective layer 820 and the lightning strike appliqué 825 that may be deployed on the conformal driveshaft cover HF antenna 110.

In a particular illustrative embodiment, the antenna layer 214 is electrically connected to a transceiver (not shown in FIG. 8) at connections 830 on opposing sides of the interior slot 216 by a pair of conductors 840. In a particular illustrative embodiment, the connections 830 are at a midpoint of the slot length of the interior slot 216, as shown in the midpoint cross-section of FIG. 8. The conductors 840 may pass through a microstrip balun 860 or a similar current balancing structure, to a high power connector 850 that is coupled to the transceiver. The high power connector 850 may be adapted to be coupled to one or more conductors (not shown in FIG. 8) that extend beneath or through the dielectric layer 212 along the length of the conformal driveshaft cover RE antenna 110 to the transceiver.

Figure 9:
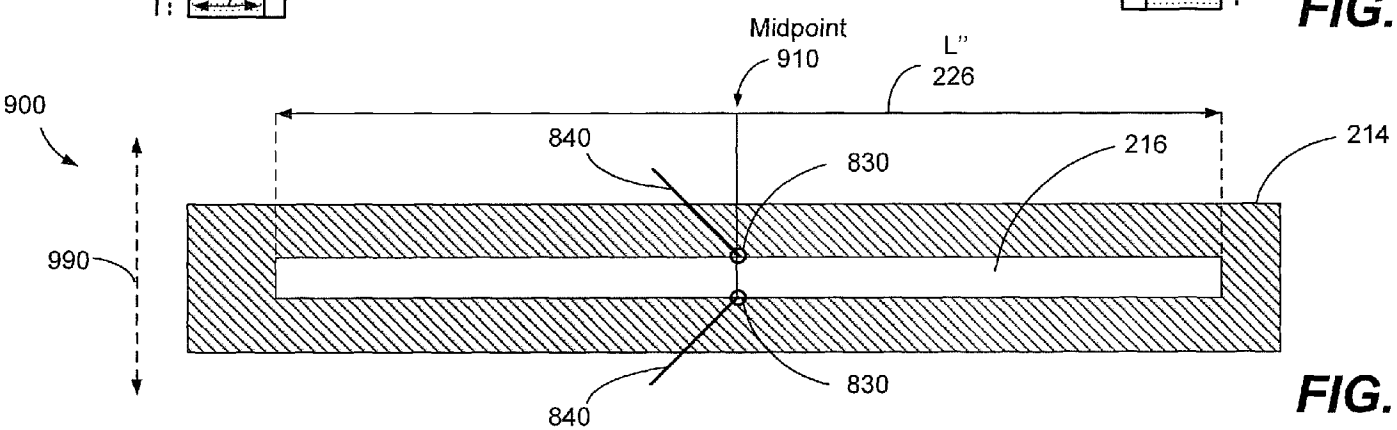
FIG. 9 is a bottom view of an antenna layer of the conformal driveshaft cover HF antenna.

FIG. 9 is a bottom view 900 of an antenna layer 214 of the conformal driveshaft cover HF antenna 110 showing the pair of conductors 840 extending from the connections 830 approximately at a midpoint 910 of the length L" 226 of the interior slot 216 of the conformal driveshaft cover HF antenna 110. The shape and size of the antenna layer 214 (including the shape and size of the interior slot 216), the dielectric layer 212, and the conductive layer 810, and the manner in which the antenna layer 214 is electrically connected to a transceiver, may enable the conformal driveshaft cover HF antenna 110 to radiate vertically polarized HF signals (illustrated in FIG. 8 as signals 890) and horizontally polarized HF signals 990, or both. The HF signals may be radiated in a bandwidth between approximately 1.8 megahertz and 30 megahertz. In a particular embodiment, the shape and size of the antenna layer 214 may be configured to radiate vertically polarized signals at one or more frequencies and to radiate horizontally polarized signals at one or more different frequencies. For example, the vertically polarized HF signals 890 may be radiated in a bandwidth between approximately 3 megahertz and 30 megahertz and the horizontally polarized HF signals 990 may be radiated in a bandwidth between approximately 1.8 megahertz and 15 megahertz.

Figure 10:
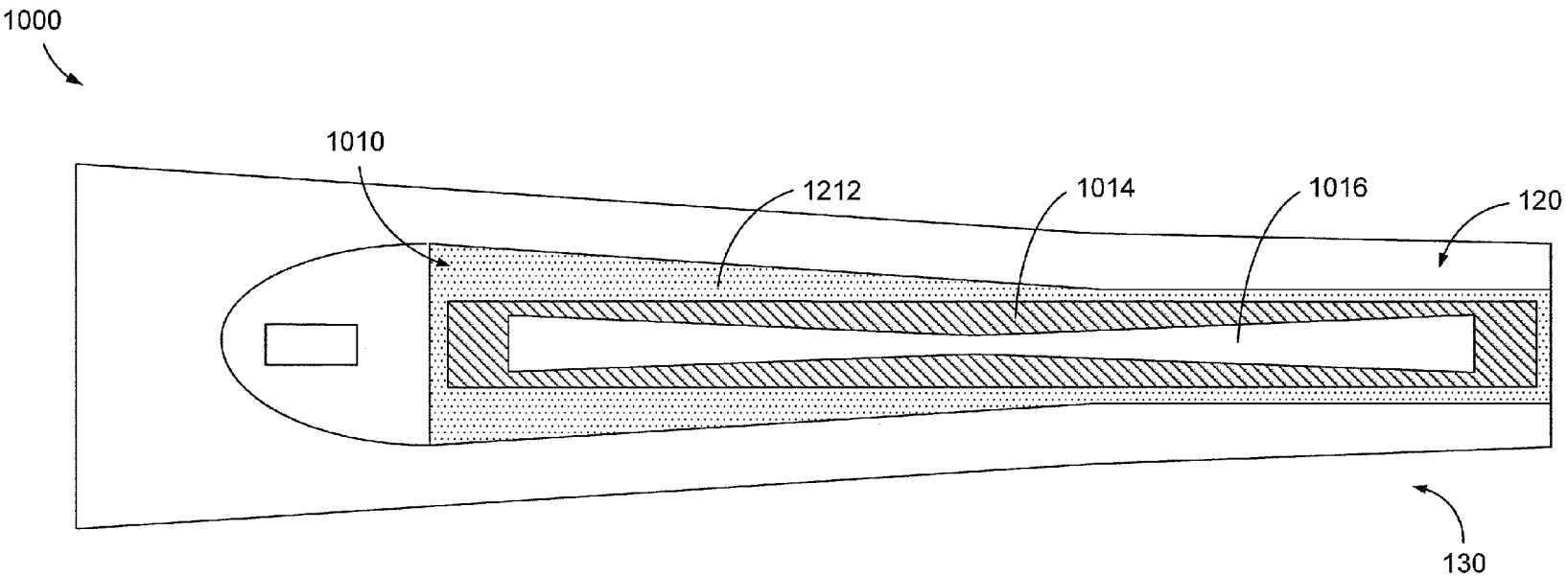
FIG. 10 is a top view of a tail boom section with a conformal driveshaft cover HF antenna that has a bowtie-shaped internal slot according to a particular embodiment.

FIG. 10 is a top view 1000 of the tail boom section 130 including another embodiment of a conformal driveshaft cover HF antenna 1010. The conformal driveshaft cover HF antenna 1010 may include a dielectric layer 1212 and an antenna layer 1014. In a particular embodiment, the antenna layer 1014 includes a bowtie-shaped internal slot 1016. Other aspects of the conformal driveshaft cover HF antenna 1010 may be similar to attributes of the conformal driveshaft cover HF antenna 110 of FIGS. 1-9. For example, the dielectric layer 1212 may be similar to the dielectric layer 212 described with reference to FIGS. 1-9. Additionally, the conformal driveshaft cover HF antenna 1010 may be coupled by hinges, latches, or both to the tail boom section 130 on the upper surface 120 of the tail boom section 130. The bowtie-shaped internal slot 1016 may enhance the radiating patterns of the conformal driveshaft cover HF antenna 1010.

Figure 11:
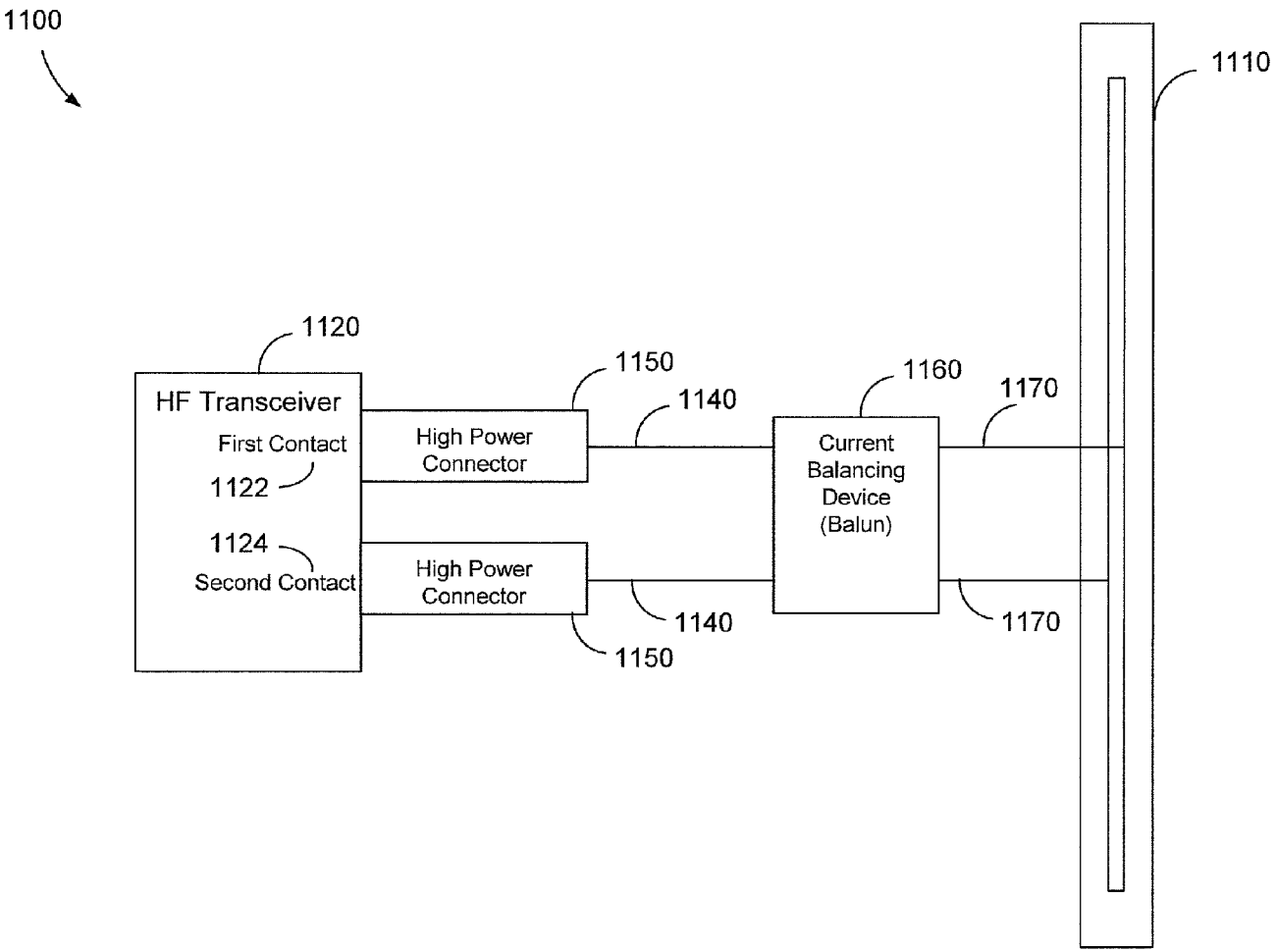
FIG. 11 is a block diagram of an HF transceiver system using an embodiment of the conformal driveshaft cover HF antenna.

FIG. 11 is a block diagram of an HF transceiver system 1100 using an embodiment of a conformal driveshaft cover HF antenna 1110. The HF transceiver system 1100 includes an HF transceiver 1120 that includes a first contact 1122 and a second contact 1124 to electrically connect to the conformal driveshaft cover HF antenna 1110. High power connectors 1150 may be used to couple conductors 1140, via a balun or other current balancing device 1160, to the conformal driveshaft cover HF antenna 1110. The HF transceiver system 1100 also includes a pair of antenna leads 1170. A first end of each of the antenna leads 1170 may be received at an opposing inner edge of an inner slot of an antenna layer of the conformal driveshaft cover HF antenna 1110. A second end of each of the antenna leads 1170 may be configured to be coupled to the HF transceiver 1120 (e.g., via the current balancing device 1160).

Figure 12:
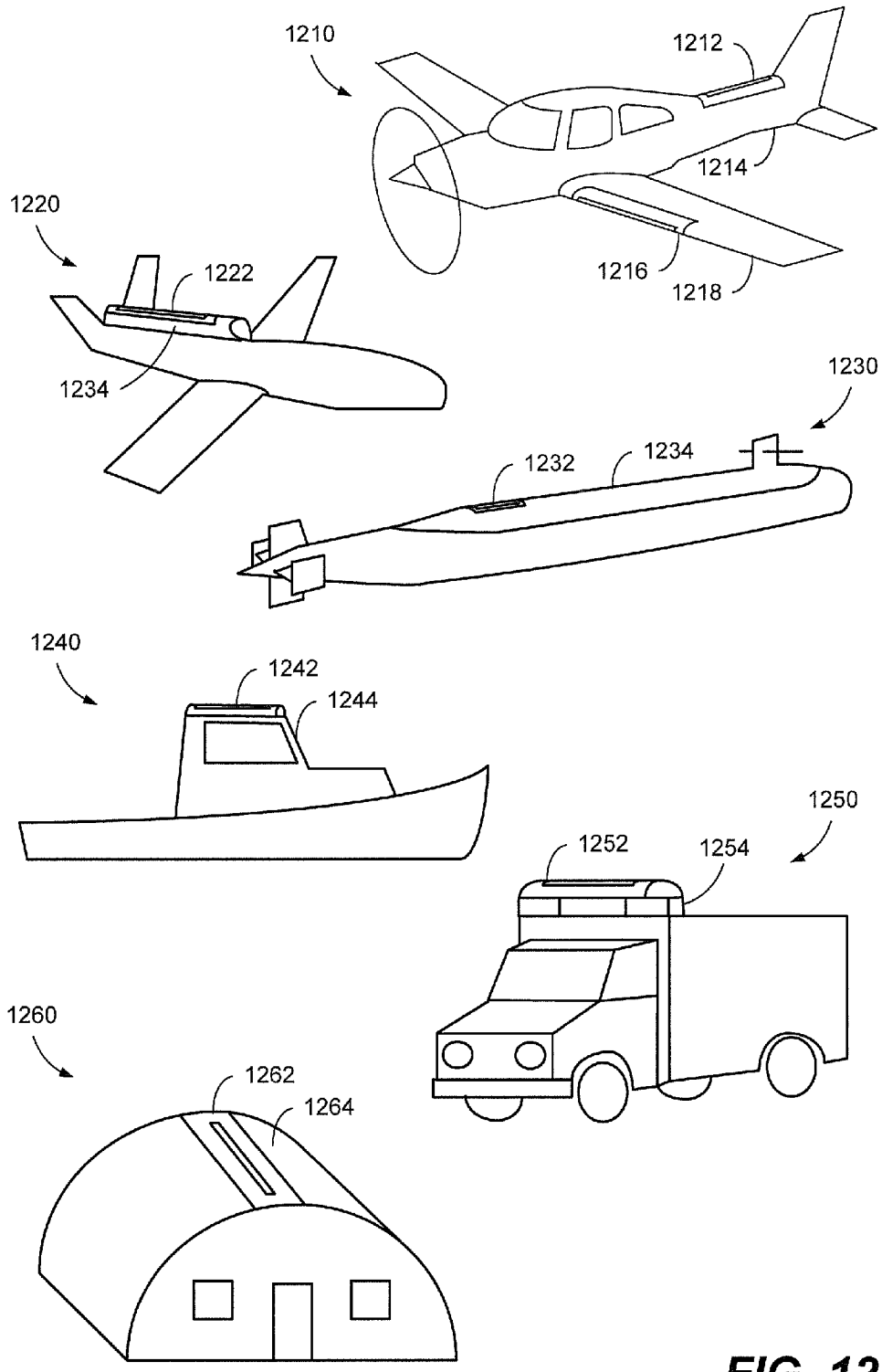
FIG. 12 is a series of perspective diagrams of potential applications of a conformal HF antenna according to particular illustrative embodiments.

FIG. 12 is a series of perspective diagrams of potential applications 1210-1260 of a conformal HF antenna according to particular illustrative embodiments of the present disclosure. Embodiments of the conformal HF antenna may be suitable and beneficial for a number of implementations where horizontally-polarized and vertically-polarized HF communications may be desirable.

Fixed wing aircraft, such as the aircraft 1210, may employ a conformal HF antenna. A conformal HF antenna 1212 may be placed on a rear fuselage 1214 of the aircraft or another section of the aircraft fuselage. Alternatively, a conformal HF antenna 1216 may be mounted on a leading edge 1218 of an aircraft wing. In both cases, a curved portion of the body or wing of the aircraft 1210 provides a suitably conductive layer on which to mount a conformal HF antenna as previously described. An unmanned aerial vehicle (UAV) 1220 may employ a conformal HF antenna 1222 mounted on an engine nacelle 1224 or other surface of the UAV 1120.

A submarine 1230 may employ a conformal HF antenna 1232 on an upper surface 1234 that extends above the water when the submarine 1230 surfaces. Although HF communications are attenuated underwater, having the conformal HF antenna 1232 mounted on the upper surface 1234 of the submarine 1230 will enable HF communications when the submarine 1230 surfaces. The conformal HF antenna 1232 thus may replace another mast-mounted antenna that may create drag on the submarine 1230 or be prone to damage. A surface boat 1240 also may employ a conformal HF antenna 1242 mounted on a housing 1244 or other surface of the boat 1240.

A land-based vehicle, such as a truck 1250 may employ a conformal HF antenna 1252. In the case of an emergency vehicle, such as the truck 1250 of FIG. 12, the conformal HF antenna 1252 may be mounted atop a light bar 1254 or other underutilized structure on the body of the truck 1250.

A fixed structure, such as the building 1260, also may employ a conformal HF antenna 1262. The building 1260, which in the example of FIG. 12 is a Quonset hut, has a curved roof 1264 that provides a suitable conductive body or conductive layer to support the conformal HF antenna 1262. However, any structure may be configured to use a conformal HF antenna by using another conductive body or conductive layer found on the structure or by providing a conductive body or conductive layer for the purpose of providing a base for the conformal HF antenna.

Figure 13:
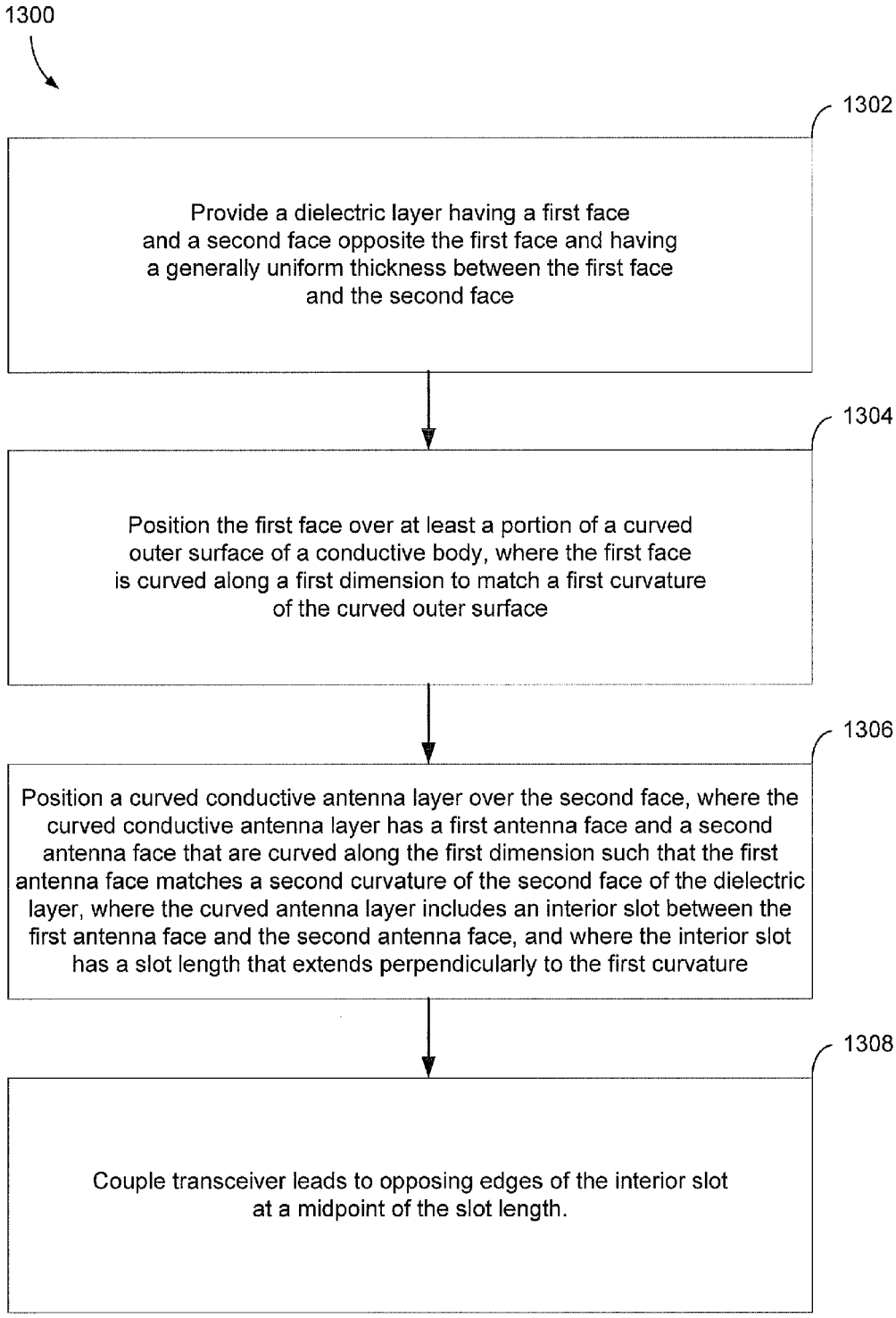
FIG. 13 is a flow diagram of a particular embodiment of a method of forming a conformal HF antenna.

FIG. 13 is a flow diagram of one particular illustrative embodiment of a method 1200 of forming a conformal HF antenna. A layer of a dielectric layer having a first face and a second face opposite the first face and having a generally uniform thickness between the first face and the second face is provided, at 1302. The first face is positioned over at least a portion of a curved outer surface of a conductive body, at 1304. The first face is curved along a first dimension to match a first curvature of the curved outer surface. A curved conductive antenna layer is positioned over the second face, at 1306. The curved conductive antenna layer has a first antenna face and a second antenna face that are curved along the first dimension such that the first antenna face matches a second curvature of the second face of the dielectric layer. The curved antenna layer includes an interior slot between the opposing antenna faces. The interior slot has a slot length that extends perpendicularly to the first curvature. Transceiver leads are coupled to opposing edges of the interior slot at a midpoint of the slot length, at 1308. For example, the method 1300 of FIG. 13 may be used to form a conformal HF antenna on a driveshaft cover of a helicopter to create a conformal driveshaft cover HF antenna such as described with reference to FIGS. 1-11.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific embodiments have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. An antenna comprising:

a dielectric layer, wherein the dielectric layer has a first curved surface and a second curved surface opposite the first curved surface;

a conductive body having a curved outer surface and a curved inner surface, wherein the first curved surface of the dielectric layer is positioned over the curved outer surface of the conductive body, wherein the curved inner surface of the conductive body is configured to be integrated with or directly coupled to a portion of a structure;

a high frequency (HF) antenna layer positioned over the second surface of the dielectric layer, wherein the HF antenna layer is curved to conform to the second curved surface of the dielectric layer;

a protective layer positioned over the HF antenna layer; and a pair of contacts configured to receive an electrical connection for the HF antenna layer, wherein, during use to radiate energy, the conductive body interacts with the HF antenna layer to radiate the energy.

2. The antenna of claim 1, wherein the first curved surface, the second curved surface, and the curved outer surface of the conductive body have partially cylindrical cross-sections.

3. The antenna of claim 1, wherein dimensions of the HF antenna layer, dimensions of the conductive body and dimensions of the dielectric layer are selected to enable vertical polarization of the energy in a first frequency band and horizontal polarization of the energy in a second frequency band.

4. The antenna of claim 1, wherein the dielectric layer comprises one of a thermoplastic syntactic foam and a polymer foam.

5. The antenna of claim 1, wherein the dielectric layer has a thickness between the first curved surface and the second curved surface of approximately one half to two inches.

6. The antenna of claim 1, wherein the HF antenna layer includes a slotted patch antenna, and wherein a length of an inner slot of the slotted patch antenna extends a majority of a length of the HF antenna layer.

7. The antenna of claim 6, wherein the pair of contacts is positioned at opposing edges of the inner slot approximately at a center of the length of the inner slot.

8. The antenna of claim 6, wherein the inner slot is one of rectangular and bowtie-shaped.

9. The antenna of claim 1, further comprising a high power electrical connector, wherein the high power electrical connector includes a current balancing structure configured to couple the pair of contacts to an HF transceiver.

10. The antenna of claim 9, wherein the current balancing structure includes a microstrip balun.

11. The antenna of claim 1, further comprising a lightning strike appliqué positioned over the protective layer, wherein the lightning strike appliqué is configured disperse an electrical charge associated with a lightning strike.

12. The antenna of claim 11, wherein the protective layer comprises a low dielectric loss quartz fiber composite material.

13. The antenna of claim 11, wherein the lightning strike appliqué comprises one of an expanded mesh and a nonconductive substrate supporting a plurality of patches of conductive material.

14. The antenna of claim 13, wherein the HF antenna layer is configured to radiate vertically polarized signals at a first range of frequencies and wherein the HF antenna layer is configured to radiate horizontally polarized signals at a second range of frequencies that is different than the first range of frequencies.

15. The antenna of claim 14, wherein the first range of frequencies is between 3 megahertz and 30 megahertz and wherein the second range of frequencies is between 1.8 megahertz and 15 megahertz.

16. The antenna of claim 1, wherein the structure is one of a driveshaft cover, a land-based vehicle, a watercraft, an aircraft, and a building.

* * * * *